US009664019B2

(12) United States Patent
Brodt

(10) Patent No.: US 9,664,019 B2
(45) Date of Patent: May 30, 2017

(54) UNDERWATER GAS FIELD DEVELOPMENT METHODS AND SYSTEMS

(71) Applicant: S.G.B.D. TECHNOLOGIES LTD., Haifa (IL)

(72) Inventor: Alexander Brodt, Beer Sheva (IL)

(73) Assignee: S.G.B.D. TECHNOLOGIES LTD., Haifa (IL)

( * ) Notice: Subject to any disclaimer, the term of this patent is extended or adjusted under 35 U.S.C. 154(b) by 378 days.

(21) Appl. No.: 13/956,537

(22) Filed: Aug. 1, 2013

(65) Prior Publication Data

US 2015/0020542 A1 Jan. 22, 2015

Related U.S. Application Data

(63) Continuation-in-part of application No. 13/950,317, filed on Jul. 25, 2013.

(30) Foreign Application Priority Data

Jul. 18, 2013 (IL) ..... 227549
Jul. 29, 2013 (IL) ..... 227707

(51) Int. Cl.
*F02M 7/20* (2006.01)
*E21B 43/18* (2006.01)
(Continued)

(52) U.S. Cl.
CPC ..... *E21B 43/18* (2013.01); *F04B 9/103* (2013.01); *F04F 1/02* (2013.01); *F25J 1/0022* (2013.01);
(Continued)

(58) Field of Classification Search
CPC ..... F04F 1/00; F04F 1/02; F04F 1/06; F04F 1/08; F04F 1/14; F04F 3/00;
(Continued)

(56) References Cited

U.S. PATENT DOCUMENTS 1,157,993 A 10/1915 McElroy et al.
2,928,249 A 3/1960 Miles
(Continued)

FOREIGN PATENT DOCUMENTS

RU 2109930 12/2002
SU 486772 10/1975
(Continued)

OTHER PUBLICATIONS

Office Action for Israeli Application No. 227549 dated Sep. 29, 2014.
(Continued)

*Primary Examiner* — Frantz Jules
*Assistant Examiner* — Webeshet Mengesha
(74) *Attorney, Agent, or Firm* — Pearl Cohen Zedek Latzer Baratz LLP

(57) ABSTRACT

Underwater gas pressurization units and liquefaction systems, as well as pressurization and liquefaction methods and gas field development methods are provided. Gas is compressed hydraulically by seawater introduced into vessels and separated from the gas by a water immiscible liquid layer. Tall, possibly vertical helical vessels are used to reach a high compression ratio that lowers the liquefaction temperature. Cooling units are used to liquefy the compressed gas, possibly by a coolant which is itself pressurized by a similar mechanism. The coolant may be selected to be liquefied under surrounding seawater temperatures. The seawater which is used to pressurize the gas may be used after evacuation from the vessels to pressurize intrastratal gas in the production stages and broaden the gas field development.

8 Claims, 5 Drawing Sheets

(51) Int. Cl.

| | |
|---|---|
| ***F25J 1/00*** | (2006.01) |
| ***F04B 9/103*** | (2006.01) |
| ***F04F 1/02*** | (2006.01) |
| ***F25J 1/02*** | (2006.01) |
| *B01F 3/04* | (2006.01) |
| *B01F 15/00* | (2006.01) |
| *F02M 9/08* | (2006.01) |

(52) U.S. Cl.
CPC ..... *F25J 1/0052* (2013.01); *F25J 1/0085* (2013.01); *F25J 1/0204* (2013.01); *F25J 1/0257* (2013.01); *F25J 1/0278* (2013.01); *F25J 1/0281* (2013.01); *B01F 3/04517* (2013.01); *B01F 15/005* (2013.01); *F02M 7/20* (2013.01); *F02M 9/08* (2013.01); *F25J 2230/22* (2013.01); *F25J 2230/30* (2013.01); *F25J 2235/04* (2013.01)

(58) Field of Classification Search
CPC .... F04B 9/0005; F04B 39/0011; F04B 47/00; F25J 1/0022; F25J 1/0052; F25J 1/0085; F25J 1/0087; F25J 2210/60; F25J 2235/04; F25J 2270/12; F25J 2290/72
USPC ..... 417/99, 101
See application file for complete search history.

(56) References Cited

U.S. PATENT DOCUMENTS

| | | | | |
|---|---|---|---|---|
| 2,942,424 | A | 6/1960 | Koble | |
| 3,605,414 | A | 9/1971 | Westmoreland, Jr. | |
| 3,727,418 | A | 4/1973 | Glazier | |
| 4,209,271 | A * | 6/1980 | McCabe | F17B 1/00 114/256 |
| 4,402,632 | A | 9/1983 | Cook | |
| 6,494,251 | B2 | 12/2002 | Kelley | |
| 8,381,544 | B2 | 2/2013 | Coyle | |
| 2004/0159437 | A1 | 8/2004 | Choi et al. | |
| 2006/0000615 | A1* | 1/2006 | Choi | B63B 27/24 166/352 |
| 2008/0041291 | A1* | 2/2008 | Horton | B65D 88/78 114/257 |
| 2009/0010717 | A1 | 1/2009 | Horton et al. | |
| 2012/0053562 | A1 | 3/2012 | Haase | |
| 2012/0285656 | A1* | 11/2012 | Moore | F25J 1/0022 165/45 |

FOREIGN PATENT DOCUMENTS

| | | |
|---|---|---|
| WO | WO 2010/049821 | 5/2010 |
| WO | WO-2012/101478 | 8/2012 |

OTHER PUBLICATIONS

M.P. Malkov, I.B. Danilov, A.G. Zeldovich, A.B. Fradkov "Handbook on Physico-Technical Foundations of Deep Cooling", Ed. Prof. M.P. Malkov, Moscow-Leningrad: Gosenergoizdat, 1963, 416 pp.

V.G. Fastovsky, Yu.V. Petrovsky, A.E. Rovinsky "Cryogenic Technology", Ed. V.G. Fastovsky, 2nd Ed., Moscow: Energia, 1974, 496 pp.

International Search Report mailed Oct. 26, 2014 for PCT International Application No. PCT/IL2014/050612.

Notice of Allowance of U.S. Appl. No. 13/950,317 mailed on Aug. 26, 2016.

Office Action of U.S. Appl. No. 13/950,317 mailed on Dec. 22, 2015.

Supplementary Partial European Search Report of European Patent Application EP 14826557 dated Feb. 2, 2017.

* cited by examiner

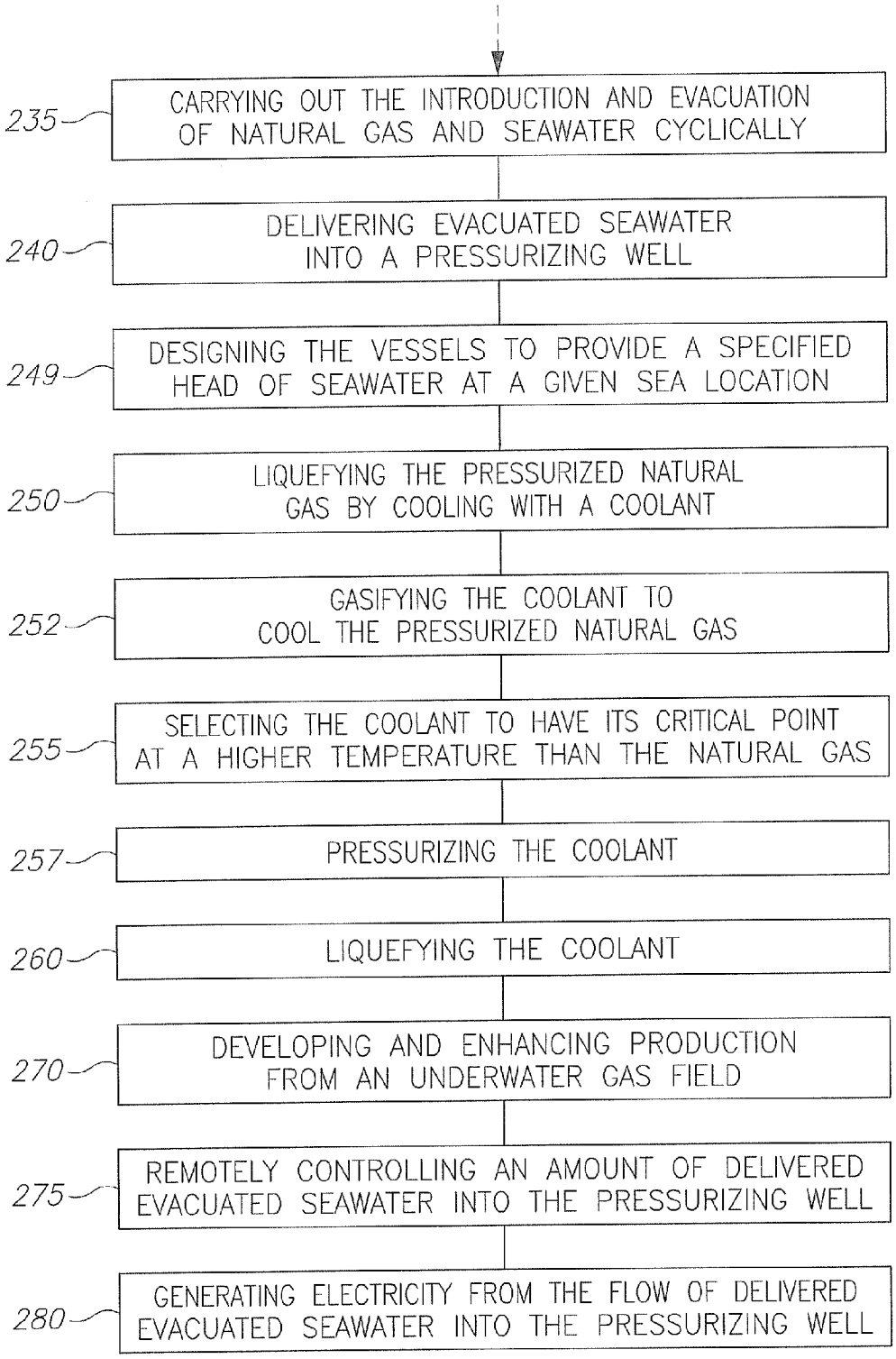
Figure 4 (cont. 1)

UNDERWATER GAS FIELD DEVELOPMENT METHODS AND SYSTEMS

CROSS REFERENCE TO RELATED APPLICATIONS

This application is a continuation in part of U.S. patent application Ser. No. 13/950,317, filed on Jul. 25, 2013, which claims priority under 35 U.S.C. §119 to Israeli Patent Application No. 227549 filed on Jul. 18 2013, which is incorporated herein by reference in its entirety. This application further claims the benefit of Israeli Patent Application No. 227707 filed on Jul. 29, 2013 which is incorporated herein by reference in its entirety.

BACKGROUND OF THE INVENTION

1. Technical Field

The present invention relates to the field of natural gas production, and more particularly, to gas pressurization and liquefaction as well as gas field development.

2. Discussion of Related Art

Natural gas liquefaction poses significant challenges regarding its energy consumption and delivery of the natural gas to the liquefaction plant. Existing technologies use energy very extensively and require long pipework to deliver natural gas that is produced from sea sources.

SUMMARY OF THE INVENTION

One aspect of the present invention provides an underwater gas pressurization unit comprising: at least one vessel arranged to receive gas through a top of the vessel and seawater through a bottom of the vessel, and further comprising a layer of water-immiscible liquid separating between the gas and the seawater, the water-immiscible liquid selected to have a density which is intermediate between a density of the gas and a density of the seawater; and a valve system arranged to pressurize the gas by introducing the seawater into the vessel, evacuate the pressurized gas through the top of the vessel upon reaching a specified pressure and introduce gas into the vessel by evacuating the seawater through the bottom of the vessel. Evacuated seawater may be controllably introduced into production wells to enhance gas production.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

For a better understanding of embodiments of the invention and to show how the same may be carried into effect, reference will now be made, purely by way of example, to the accompanying drawings in which like numerals designate corresponding elements or sections throughout.

In the accompanying drawings.

DETAILED DESCRIPTION OF THE INVENTION

Figure 1:
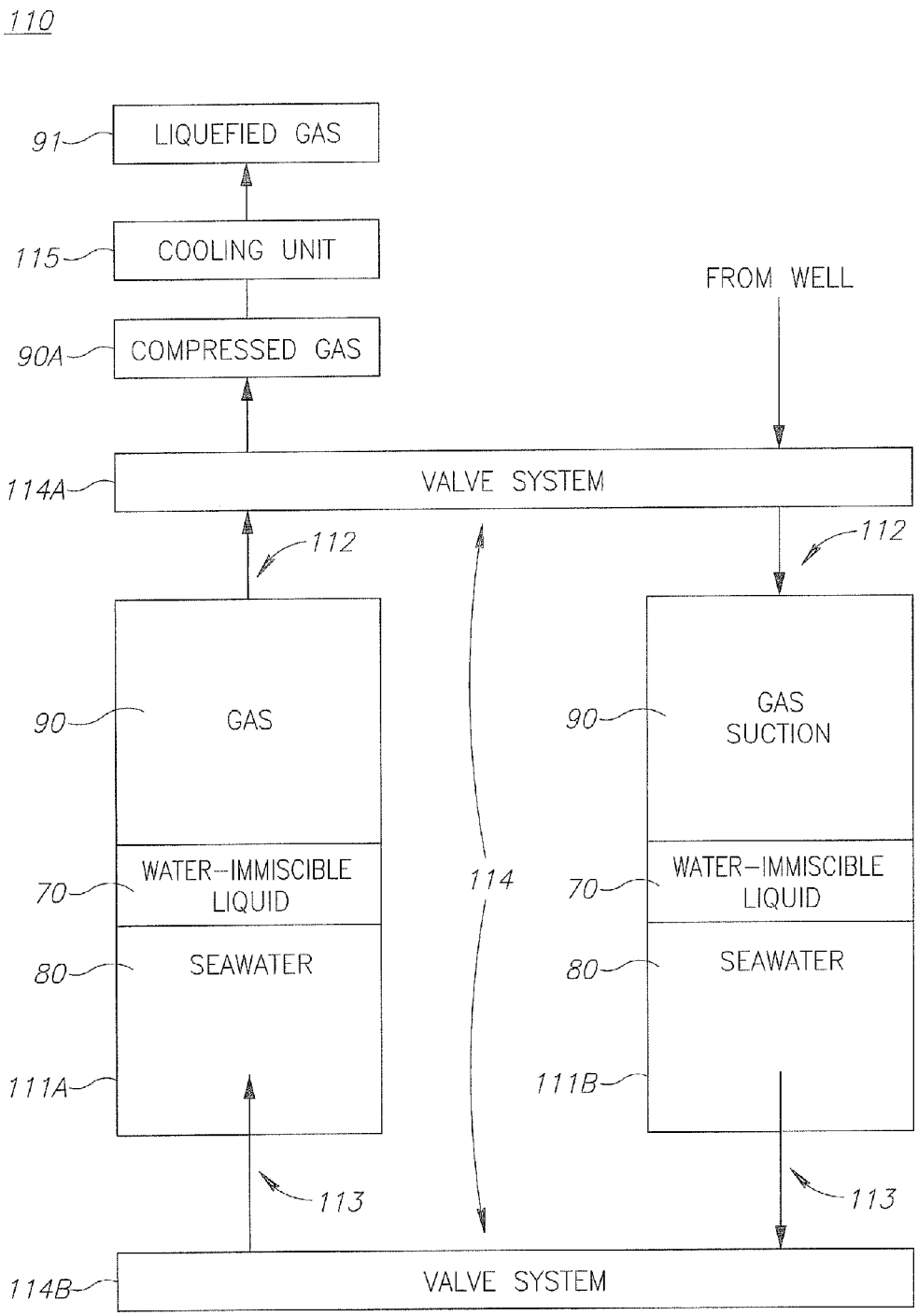
FIG. 1 is a high level schematic block diagram of an underwater gas pressurization unit, according to some embodiments of the invention.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

In certain embodiments, underwater gas pressurization units and liquefaction systems, as well as pressurization and liquefaction methods are provided. Gas is compressed hydraulically by introduced seawater, which is separated from the gas by a water-immiscible liquid layer. The seawater is delivered gravitationally by utilizing deep sea pressures; the rising water compresses the gas in the top of the compression vessels. Tall, possibly vertical helical vessels may be used to reach a high compression ratio that lowers the liquefaction temperature. Cooling units are used to liquefy the compressed gas, possibly by a coolant which is itself pressurized by a similar mechanism. A cascade having two or more stages of compression and cooling units may be used to allow eventual cooling by ambient seawater. In certain embodiments, the coolant may be selected to be liquefied at surrounding seawater temperatures. The dimensions and forms of the vessels, the coolants and the implementation of the cooling units are selected according to the sea location, to enable natural gas liquefaction in proximity to the gas source. The seawater which is used to pressurize the gas may be used after evacuation to pressurize intrastratal gas in the production stages.

FIG. 1 is a high level schematic block diagram of an underwater gas pressurization unit 110, according to some embodiments of the invention. Underwater gas pressurization unit 110 comprises at least one vessel 111, illustrated in FIG. 1 in two operation states, denoted 111A for gas pressurization and 111B for gas suction, as explained below. Vessel 111 is arranged to receive gas 90 through a top 112 of the vessel, e.g., through a top opening, and seawater 80 through a bottom 113 of the vessel, e.g., through a bottom opening.

Underwater gas pressurization unit 110 comprises a valve system 114 having a top subsystem 114A in fluid communication with top 112 of vessel 111 and a bottom sub system 114B in fluid communication with bottom opening 113. Subsystems 114A, 114B are arranged to control and regulate introduction and evacuation of gas 90 and seawater 80, respectively. Valve system 114 is arranged to pressurize gas 90 by introducing seawater 80 into vessel 111, evacuate pressurized gas 90A through top opening 112 upon reaching a specified pressure and introduce gas 90 into vessel 111 by evacuating seawater 80 through bottom 113 of vessel 111.

Vessel 111 further comprises a layer of water-immiscible liquid 70 arranged to separate seawater 80 from gas 90 during the pressurizing and the suction of gas 90. Liquid 70 is selected to have an intermediate density between the densities of seawater 80 and gas 90. The density selection (at working temperatures and pressures) is arranged to maintain layer of water-immiscible liquid 70 on top of seawater 80.

In certain embodiments, gas 90 goes through a preliminary purification of the initial raw material to remove harmful impurities. Then, gas goes through compression (at 111) and condensation (at cooling units 115, see below).

In certain embodiments, water-immiscible liquid 70 may comprise aliphatic or aromatic organic compounds or their mixtures, and may have a density smaller than seawater and a freezing temperature below −20° C. For example, water-immiscible liquid 70 may be selected from: hexane, hexane isomers, heptane, heptane isomers, toluene, derivatives thereof and mixtures thereof.

The absence of any mechanical devices with electric drives for compressing gaseous media in the method of methane liquefaction, and their compression in underwater vertical vessels at the expense of pressing the gaseous phase out of the vessels by feeding seawater 80, allows not only a drastic decrease in the cyclicity of the operation of such piston compressors that do not contain any moving mechanical parts, but also practically completely get without electric energy consumption for the realization of the process. Besides, the underwater location of high-pressure vessels 111 allows a considerable decrease in their materials output ratio (external hydrostatic pressure of seawater compensates the internal pressure, which makes it possible to make such equipment with thinner walls). The absence of high-speed mechanical compressor equipment with powerful electric drives not only reduces the price of the instrumental design of the process of the invention, but also significantly increases the safety of operation of such sea-bottom gas field.

Advantageously, all distinguishing features of the present invention are organically interconnected, and their mentioned combination allows the achievement of the object of the invention. The invention is however not to be understood as being limited by the details of the implementation that is exemplified below.

Underwater gas pressurization unit 110 may be associated with a natural gas production platform 20 and receive natural gas as gas 90 from platform 20. Liquefied natural gas 90 may be stored in an underwater storage or be delivered to the shore. Vessels 111 are arranged to withstand underwater pressure, with respect to the operation conditions of unit 110. Underwater gas pressurization unit 110 may further be arranged to compress and/or liquefy other gases or gas mixture. In certain embodiments, underwater gas pressurization unit 110 may be arranged to compress and/or liquefy coolants that are used to liquefy natural gas 90, as illustrated below. Multiple underwater gas pressurization units 110 may be arranged as a cascade to compress gas 90 step-wise, each stage of the cascade receiving compressed gas and further compressing the received gas. Multiple underwater gas pressurization units 110 may be arranged in a cascade to compress and liquefy several types of gases, having rising critical point temperatures, to enable cooling of the last gas in the cascade by sea water, e.g., by deep sea water. In such an arrangement, the cooling effect of sea water is gradually intensified to enable cryogenic cooling of the first gas in the cascade. A non-limiting detailed example is presented below.

Advantageously, disclosed systems and methods ensure the possibility of sea gas field development with the delivery of the produced natural gas in the liquefied form immediately at the production site in underwater conditions, with a simultaneous decrease of volumes of conditioned power resources required for the realization of such a process. In certain embodiments, to achieve this object, the natural gas is sucked into an underwater hollow pipe coil, which is in the filling phase. After that, it is compressed by an ascending column of sea water screened by a layer of immiscible hydrocarbon liquid owing to the ingress of sea water from below, under the layer of non-aqueous liquid, due to a high external hydrostatic pressure. Natural gas is thus compressed to a pressure not less than the critical one, and is fed to liquefaction realized by its cooling and condensation by an external cryogenic cold-carrier, which is located in the loop of its own circulation. After that, most part of the sea water is pumped out of the pipe coil before its filling with the next portion of natural gas at the initial stage of gas field development. At the second stage of the field development, sea water outgoing of the pipe coil compressing natural gas is supplied to flooding underwater gas field.

Advantageously, the use of external hydrostatic pressure of sea water (fed afterwards to the flooding of shelf gas field at the second stage of its development) for the natural gas compression makes it possible to do without piston compressors that are traditionally used in methane liquefaction cycles and represent not only powerful electric energy consumers, but also rather low-efficiency devices. This makes it possible both to deliver the entire volume of the produced natural gas in the liquefied form directly at the site of its production, and to reduce sharply the power intensity of such gas field development.

Figure 2:
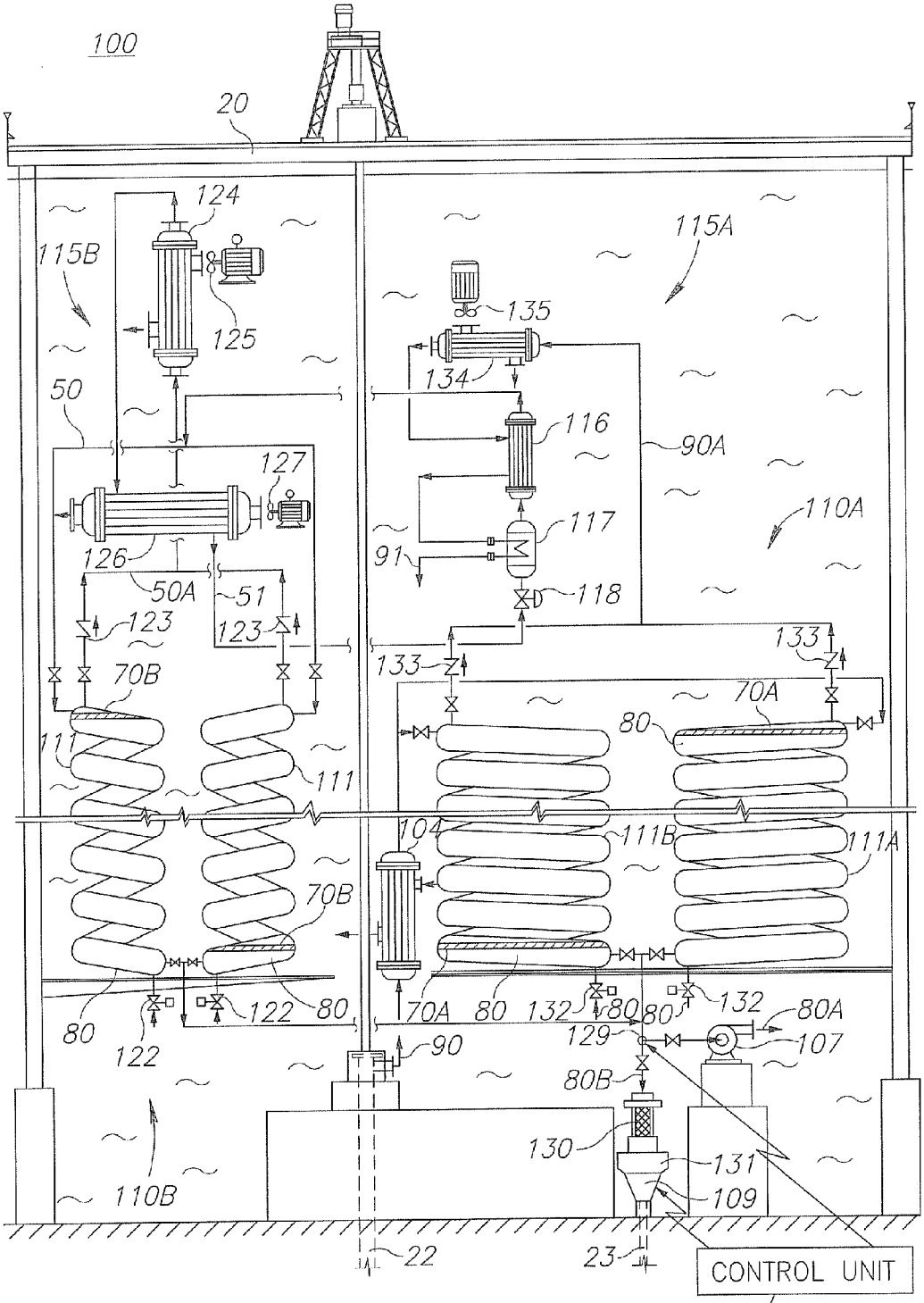
FIG. 2 is a high level schematic block diagram of an underwater natural gas liquefaction system, according to some embodiments of the invention.
Figure 3:
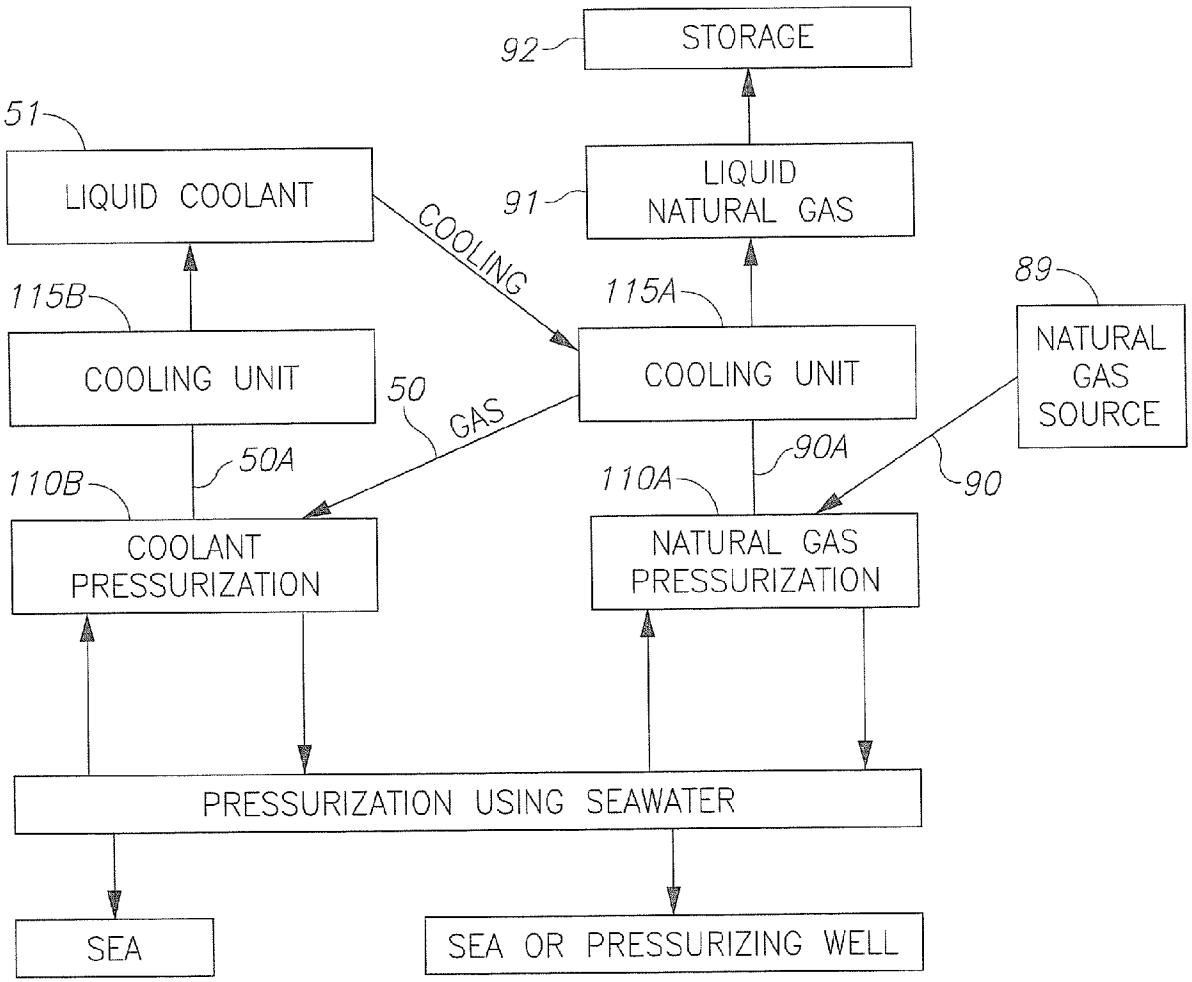
FIG. 3 is a high level schematic illustration of underwater natural gas liquefaction system, according to some embodiments of the invention.

FIG. 2 is a high level schematic block diagram of an underwater natural gas liquefaction system 100, according to some embodiments of the invention; FIG. 3 is a high level schematic illustration of underwater natural gas liquefaction system 100, according to some embodiments of the invention. In certain embodiments, underwater natural gas liquefaction system 100 may comprise two underwater gas pressurization units 110A, 110B arranged as a cooling and pressurizing cascade for efficiently liquefying natural gas. A first unit 110A may be arranged to pressurize natural gas 90 and a natural gas cooling unit 115A may be arranged to liquefy pressurized natural gas 90A (to yield liquid natural gas 91) using a coolant 50. Coolant 50 may be selected to have its critical point at a higher temperature than natural gas 90. A second unit 110 may be arranged to pressurize coolant 50 and a cooling unit 115 may be arranged to liquefy pressurized coolant 50A (to yield liquid first coolant 51) using seawater. In certain embodiments, system 100 may comprise additional stages using additional coolants, or several pressurization stages (each with corresponding vessels 111) for each coolant and so forth. The number and type of coolants and the number and specifications of pressurization units 110 may be determined according to sea conditions (depth, surface temperatures, construction limitations) and operational considerations.

Natural gas 90 produced from the sea bottom (as a natural gas source 89) for liquefaction by platform 20 may be prepared by its dewatering from water vapors and purification (if necessary) from harmful impurities, such as hydrogen sulfide and carbon dioxide. Then, natural gas 90 may be introduced by suction into one of underwater vessels 111 by discharging the column of seawater 80 screened by a liquid hydrocarbon 70, as explained above. Natural gas 90 may be compressed in vessels 111 with a subsequent pressing-out of natural gas portion collected in the vertical underwater vessel 111 by feeding seawater into cylinder 111 from the surrounding deep sea. Subsequently, system 100 may carry out cooling and condensation of compressed natural gas 90A, at the expense of evaporation of coolant 50. The natural gas, being under elevated pressure, is pressed-out for liquefaction from underwater vessel 111 by a rising column of seawater 80. The liquefied natural gas 91 may be accumulated in an underwater storage 92 with its subsequent shipping and delivery to sea-shore consumers by pipeline transportation or by sea shipping in specialized tankers. Seawater 80 may be introduced into vessels 111 by gravity, utilizing height differences which are available in the sea. Coolant 50 may be pressurized in a similar pressurization unit 110B and cooled to liquefaction in cooling unit 115B. Details of system 100 which are illustrated in FIG. 2 are explained in the example presented below.

Figure 4:
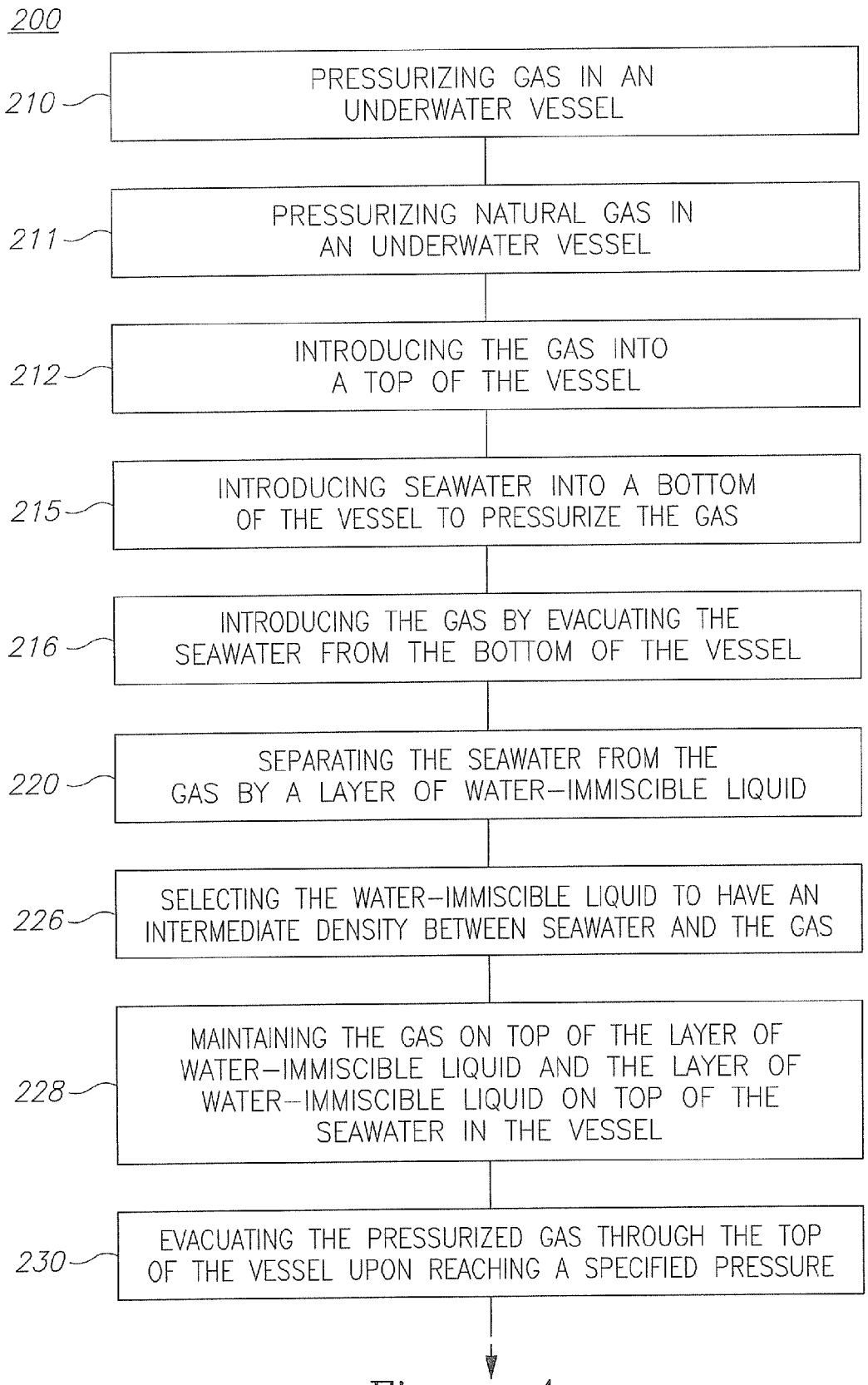
FIG. 4 is a high level schematic flowchart illustrating a gas compression and liquefaction method, according to some embodiments of the invention.

FIG. 4 is a high level schematic flowchart illustrating a gas compression and liquefaction method 200, according to some embodiments of the invention. Method 200 may comprise pressurizing gas, such as natural gas or other gases such as ethylene or methane. Method 200 may further comprise cooling the compressed gas to liquefy it. For example, pressurizing the gas may surpass the pressure of its critical point and cooling the compressed gas may thus liquefy the gas. In certain embodiments, method 200 may compress and liquefy natural gas, as illustrated in a non-limiting example below.

Method 200 comprises pressurizing the gas in at least one vessel (stage 210), e.g., pressurizing natural gas (stage 211), by cyclically (stage 235): (i) introducing the gas into a top of the at least one vessel (stage 212); (ii) introducing seawater into a bottom of the at least one vessel to pressurize the gas (stage 215); separating the seawater from the gas by a layer of water immiscible liquid (stage 220); and evacuating the pressurized gas through the top of the at least one vessel upon reaching a specified pressure (stage 230). The pressurization may be carried out cyclically (stage 235), e.g., by introducing the gas by evacuating the seawater from the bottom of the at least one vessel (stage 216). Thus natural gas may be continuously pressurized by introducing and evacuating the seawater.

In certain embodiments, method 200 may further comprise selecting the water immiscible liquid to have an intermediate density, between the densities of the gas and the seawater (stage 226), to maintain the gas on top of the layer of water-immiscible liquid and the layer of water-immiscible liquid on top of the seawater in the vessel (stage 228).

In certain embodiments, method 200 may further comprise delivering the evacuated seawater into a pressurizing well (stage 240). In certain embodiments, the evacuated seawater may be delivered into the ambient sea or into one or more pressurizing wells, depending on the production requirements. The delivered seawater may be filtered prior to delivery and pumped into the pressurizing well.

In certain embodiments, method 200 may further comprise liquefying the pressurized natural gas by cooling with a coolant (stage 250) and selecting the coolant to have its critical point at a higher temperature than the natural gas (stage 255). Cooling by the coolant (stage 250) may comprise gasifying the coolant to cool the pressurized natural gas (stage 252). In certain embodiments, method 200 may further comprise pressurizing the coolant (stage 257) and liquefying the pressurized coolant (stage 260). Pressurizing the coolant 257 may be carried out by method 200, e.g., according to stages 212, 215, 216, 220, 230 and 235.

Certain embodiments comprise an underwater gas field development method comprising underwater natural gas liquefaction method 200 and delivering the evacuated the evacuated seawater into the pressurizing well to enhance gas production (stage 240). Method 200 may further comprise developing and enhancing production from an underwater gas field (stage 270), as well as remotely controlling an amount of delivered evacuated seawater into the pressurizing well (stage 275) and generating electricity from the flow of delivered evacuated seawater into the pressurizing well (stage 280).

In certain embodiments, method 200 may be realized by successive realization of the following main technological operations.

During the initial development of the gas field: drilling of production and pressure boreholes from the board of drilling platform for opening the underwater gas deposit; equipping the production and pressure boreholes with additional technological equipment, pipelines, auxiliary facilities and stop valves, as well as with means of telemetric control and telemechanical handling of principal production parameters and natural gas liquefaction in underwater conditions, assuring, meanwhile, a total safety of the operation of such sea gas field; and starting natural gas delivery from underwater field by production boreholes.

Then, the produced natural gas may be compressed by applying the following stages: precooling of the produces natural gas by blind heat exchange with the surrounding sea water; sucking-in of natural gas from producing wells and precooled with sea water into the system of its underwater compression and condensation made in the form of underwater pipe coils working in antiphase with emptying their internal helical space from the most part of sea water (by forced sea water swinging at the first stage of the field development and gravity discharge of sea water by pressure wells into the gas pool after the beginning of intrastratal pressure drop at the second stage of the sea gas field development); and flooding of the pipe coil, after sucking-in natural gas, with sea water supplied from below, its column inside such coil being screened by a layer of water-immiscible hydrocarbon liquid. At that, the compressed gas is pressed out of such hydraulic compressing facility.

Finally, the compressed natural gas may be cooled and liquefied according to the following stages: cooling of natural gas compressed in the coil with sea water, and then with an external cryogenic cold-carrier; condensation of the compressed natural gas cooled by cryogenic cold-carrier down to the liquefaction temperature; compression and condensation of the vapors of external (with respect to the liquefied natural gas) cold-carrier boiling at the transfer of its cold to the condensing methane in the underwater system of liquefaction of such cryogenic liquid. The system operates according to a similar scheme including a couple of antiphase-operated underwater coils and heat-exchange facilities using sea water as a cooling medium; and returning the regenerated cryogenic liquid into the cycle of methane liquefaction.

The liquefied natural gas may be accumulated in underwater storage and its subsequent shipment and delivery to coastal consumers by underwater pipeline transport or by sea transport using specialized ships.

Advantageously, compression by seawater 80 is superior to compression in current pistons or other mechanical compression unit in the following aspects. First, the compression heat is dissipated into the seawater and the sea, and does not damage moving parts (e.g., bearings, insulation rings etc.). Second, gas introduction by evacuation of seawater 80 is more efficient than using the return stroke of a piston system, especially at high operation speeds. Also, the compression by liquid is more scalable than piston system, which must face the difficulty of increasing inertia of the piston head. Finally, due to the reduction of the number of mechanical parts, underwater operation and flame retarding nature of seawater 80, the disclosed systems and methods are significantly safer than current systems.

EXAMPLE

The following is a non-limiting example for a realization of system 100 and units 110 and 115. Implementation details are to be adjusted with respect to specific locations and requirements.

After opening the underwater gas field from sea drilling platform 20 (or from a special sea ship) and establishing producing wells 22 and pressure wells 23, natural gas that ascends to the sea bottom surface through producing well 22 is cooled in an underwater heat exchanger 104 down to the temperature 5-7° C. close to that of near-bottom sea water layer (2-4° C.). After that, it is sucked into one of antiphase operating pipe coils 111. Natural gas 90 may be compressed in any configuration of vessels 111 and in vessels 111 having various designs. The following non-limiting example refers to helical vessels 111 which operate pairwise—one vessel compresses gas (e.g., vessel 111A in FIG. 2 is illustrated at the end of the compression phase) and the other vessel sucks in gas (e.g., vessel 111B in FIG. 2 is illustrated at the end of the suction phase). Vessels 111 are illustrated in a non-limiting manner to have a helical form, referred to in the following as coils.

In certain embodiments, water-immiscible liquid 70 may comprise various water-immiscible aliphatic or aromatic organic compounds having a low freezing temperature and the density smaller than that of seawater 80, for example, hexane or toluene. Water-immiscible liquid 70 may comprise hexane (density 0.66 g/cm$^3$, freezing point −95.3° C.) or its isomers (2-methylpentan, freezing point −153.7° C.; 3-methylpentane, freezing point −118° C.; 2,3-dimethylbutane, freezing point −128.5° C.), heptane (density 0.69 g/cm$^3$, freezing point −90.6° C.), as well as its numerous derivatives and other representatives of the alkane homologous series of organic aliphatic compounds.

At the first stage of gas field development, when gas pressure in the well is high, sea water column 80 flooding pipe coils 111 at the beginning of natural gas sucking-in phase (111B) after the compression of the preceding portion of methane in it, is pumped back to the sea (as seawater 80A) by pump 107 emptying pipe coil 111 from the most part of its content. However, coil 111 is not pumped out completely; a small sea water layer 80 screened with liquid hydrocarbon layer 70 remains in it.

In the course of gas field operation, intrastratal gas pressure in it gradually decreases, and, respectively, the gas recovery starts dropping. At this second stage of sea gas field development, intrastratal pressure may be maintained at the required level to assure continuous and stable gas recovery by direct sea water discharge into underwater gas field (as seawater 80B) through underwater hydraulic turbine 109 mounted at the head of pressure well 23 instead of pumping the evacuated sea water out of coils 111 by pump 107. A filtering box 130 may be positioned at the input of the injection facility to prevent contamination on the blades of hydraulic turbine 109. Electric energy generated by a turbogenerator 131 may be used as an additional source of energy and compensate for some of the operational energy. Advantageously, such energy generation recovers some of the energy and makes the illustrated process more profitable. The gas field may be flooded in a controllable mode, and therefore, the volume of sea water fed from coils 111 to hydraulic turbine 109 may be recorded every second by respective telemetric measuring equipment in a control unit 140, located e.g., on platform 20. Seawater discharge and pumping rates may be controlled by a remotely controlled stop valve 129, which may be likewise controlled by control unit 140.

As a result of smooth evacuation of seawater 80, the sea water level in coils 111 decreases gradually, and the hollow helical space above liquid hydrocarbon layer 70 is filled with the next portion of freshly produces natural gas precooled by sea water in heat exchanger 104 to 5-7° C. To compress the next portion of natural gas, hydrostatic pressure of the overlying sea water column is used. For that, a remotely controlled adjustable stopcock valve 132, mounted at the basis of coil 111, is slightly opened. As a result, sea water starts entering from below into coil 111 (filled with gas 90 that was sucked in during the seawater evacuation in the former stage). Seawater 80 enter vessel 111 in a helically swirling flow that gradually pressurizes and compresses the natural gas in the seawater-free space. The final pressure of the gaseous medium (90A) in this hydraulic compressor is determined by the difference between geodetic marks of the top of hydrocarbon screening layer 70 that covers seawater 80 in underwater coil 111 and the sea level. Hence, with increasing depth of underwater production, the maximum possible pressure of gas compression in coil 111 steadily grows, too. For example, if the sea level exceeds the geodetic mark of the surface of hydrocarbon layer 70 of sea water column in coil 111 by 1000 meters, then the pressure of gas medium compressed in vessel 111 equilibrates this depth and is hence equivalent to 1.03·1000=1030 meters of fresh water column (the density of cold sea water depends on its temperature and salinity, but on the average equals 1.03 g/cm$^3$) or 1030·9806.65=10100849 Pa, i.e., 10.1 MPa. It is noted that in order to condense methane, it is not obligatory to compress it to such a high pressure (the critical pressure of methane is much lower—4.64 MPa). The main condition of its transition into liquid state is the necessity to cool it down to the temperature below the critical one (−82.5° C.).

After compression, the compressed gas may be condensed using an external cryogenic cold-carrier 50, which has a boiling point below −82.5° C. For example, ethylene $C_2H_4$ can be used as such low-boiling liquid. The thermodynamic properties of cryogenic liquid 50 are selected such that its normal boiling point at the atmospheric pressure is −103.7° C., i.e., 21.2° C. below the condensation temperature of methane (as the main component of natural gas 90) compressed up to its critical pressure. Meanwhile, the critical temperature of ethylene liquefaction is positive and amounts to 9.3° C., i.e. 5-6° C. above the sea water temperature over the most part of the world ocean starting from depths of 100 meters and more. In general, liquid coolant 51 may be selected to have a boiling point at atmospheric pressure which is lower than a condensation temperature of compressed natural gas 90A and a critical condensation temperature of pressurized coolant 50A which is higher than a temperature of ambient seawater. Therefore, ethylene may be used as coolant 50 that enables methane liquefaction as well as consecutive condensation in seawater temperatures. Such a system uses the free-of-charge cooling potential of the sea water of the world ocean having the all-the-year-round temperature of the deep-sea zone on the order of 2-4° C. Hence, ethylene 50 compressed to the pressure above the critical one (5.11 MPa) can be transferred from gaseous into liquid state in underwater conditions at the expense of heat exchange with the surrounding sea water only. Therefore, liquid ethylene is used in the present case as a non-limiting example for low-boiling cryogenic liquid 50 for methane liquefaction.

Prior to cooling by coolant 50, natural gas 90 may be alternately compressed in coils 111 to the pressure of at least 4.64 MPa, preliminarily cooled in refrigerator 134 laved with cold sea water (temperature 2-4° C.) by propeller 135. The pressure of natural gas compression may be preset beforehand according to the adjustment of check valves 133 operation at a certain threshold value. The compressed methane 90A cooled in this way to the temperature 5-6° C. is fed to the first stage of artificial cooling realized in recuperative heat exchanger 116, in which the last residues of artificial cold removed by boiling ethylene 50 from the natural gas condensation system are transferred to the former. Methane condensation at the temperature below −82.5° C. occurs in cold-exchanger 117, into which liquid ethylene 51 (boiling in normal conditions at the temperature −103.7° C.) is fed, after being throttled in adjustable valve 118.

The ready product, liquefied natural gas 91, may be sent to storage 92 in an underwater depot, wherefrom it may be shipped to consumers by special sea transport or delivered in liquid state to the coast by an underwater pipeline.

Ethylene that passed from the liquid (51) to gaseous (50) state at the temperature 103.7° C. is fed from cold-exchanger 117 to transfer last residues of its artificial cold to a fresh flow of compressed natural gas 90A. After that, ethylene vapors are fed to the system of liquefaction of cryogenic fluid for compression (in unit 110B) and condensation (in unit 115B). For this purpose, gaseous ethylene 50 leaving recuperative heat exchanger 116 is sucked into one of pipe coils 111 in pressurizing unit 110 operating, just as coils 111 in pressurizing unit 110A, in antiphase with respect to one another.

In vessels 111, sucking-in occurs owing to the discharge, in the course of emptying, of most part of seawater 80 pumped back into the sea by pump 107 (at the first stage of sea gas field development), or by a direct sea water discharge (alternately from each coil 111) into the gas pool through hydraulic turbine 109 with a simultaneous electric energy production by turbogenerator 131 (at the second stage of the sea gas field development). Similarly to the structure of the contents of coils 111 in unit 110A, the helical sea water column 80 in coils 111 is isolated from natural gas by a layer of liquid hexane 70B, which prevents water vapor penetration into the medium under compression. Water immiscible liquids 70A and 70B in units 110A, 110 may be similar or different from each other. For example, liquid 70B may be a hydrocarbon mixture that is more adapted to separate ethylene from seawater, while liquid 70A may be a hydrocarbon mixture that is more adapted to separate natural gas from seawater. After the intake of gaseous ethylene into the helical space of one of coils 111 (in unit 110B), the subsequent compression of the gas therein is realized just as in coils 111 (in unit 110A)—by alternate opening of cocks 122 fitted with drives with remote control. As a result, sea water surrounding such system starts replenishing the non-discharged two-layer column of the liquid medium. As a result (due to a steady growth of the level of the content of each coil 111), the pressure of ethylene vapor above the surface of hexane layer 70B starts gradually growing and reaches the level required for its liquefaction at positive temperatures of the surroundings—at least 5.11 MPa. After the actuation (e.g., owing to the overshoot of the established threshold value of the compression pressure) of one of check valves 123, compressed ethylene 50A leaves the compressing system and is fed for pre-cooling into refrigerator 124 laved with cold sea water by propeller 125.

Compressed ethylene 50A pre-cooled in this way is then fed to a deep-water condenser 126 installed at a lower level than refrigerator 124, since the sea water temperature monotonically decreases with growing sea depth. Since the sea water pumped by propeller 127 through condenser 216 has a lower temperature (2-4° C.) than that of the condensation of ethylene (9.3° C.), which is compressed to the pressure exceeding the critical one, vapors of this organic substance are transformed from the gaseous into the liquid state.

The obtained cryogenic liquid 51 in the re-condensed form is then fed again for throttling into controlled valve 118, and after the pressure drop therein down to the atmospheric one, is used again as cold-carrier boiling at the temperature 103.7° C. for methane liquefaction in cold-exchanger 117. Thus, the cycle of the maintenance of methane liquefaction process by a cryogenic liquid is practically completely closed, and at proper production standards, it is not practically consumed in such a closed circulation loop.

Advantageously, disclosed methods and systems, as compared to known methods of sea gas fields development, provides a number of essential technical and economic advantages. First of all, they allow supplying natural gas produced in a sea field to the consumers right away in the liquid form. This advantage allows the development of the most part of sea gas field explored by the present moment, which are located at the distance of hundreds and thousands of kilometers from the coast. Note that the fact that one cubic meter of liquefied natural gas is 625 times heavier than one cubic meter of gaseous methane is the main reason of low cost efficiency of transportation of such fuel over large distances and of the absence of stimulus for the development of sea gas fields very far from land.

As for the competitiveness of the disclosed methods and systems with respect to known methods of methane liquefaction used at the development of gas fields on land, natural gas compression in the helical space of pipe coils is an incomparably less cyclic process than the use of piston compressors, since geometrical volumes of working cylinders of such facilities can differ hundreds-fold and thousands-fold (at the internal diameter of the helical space measured in meters, spiral winding radius in tens of meters, and total spiral height in hundreds of meters). Thus, not only a drastic increase in the productivity of the compression process is ensured, but a much higher level of its power perfection is achieved, since the intensification of piston compressors operation is connected with heat generation growth and, thus, a decrease in the share of electric power transformed into an increase in the compressed gas pressure. Hence, the disclosed methods and systems are much more scalable than piston based systems and their advantages increase with increasing system size.

A simultaneous electric power generation at the emptying of the main part of the helical working space of coils at the second stage of sea gas field development (when the sea water obtained at the emptying of the hydraulic system of methane and ethylene compression is discharged through the hydroturbine with a turbogenerator into the gas pool for maintaining the intrastratal pressure in it at the necessary level) increases the profits of natural gas production from the sea bottom by the method of the invention.

An additional advantage of the invention is that with growing sea depth, the cost efficiency of the underwater methane liquefaction used in the work of such gas fields only increases, which can be attributed to the growth of sea water hydrostatic pressure and a steady decrease of its temperature with the approach to the sea bottom.

These advantages also imply that the environmental footprint of the disclosed invention is much smaller than of current technologies. Not only is the energy efficiency of the process itself is higher, but the energy and space requirements for gas transportation and liquefaction in land are spared.

In the above description, an embodiment is an example or implementation of the invention. The various appearances of "one embodiment", "an embodiment", "certain embodiments" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Certain embodiments of the invention may include features from different embodiments disclosed above, and certain embodiments may incorporate elements from other embodiments disclosed above. The disclosure of elements of the invention in the context of a specific embodiment is not to be taken as limiting their used in the specific embodiment alone.

Furthermore, it is to be understood that the invention can be carried out or practiced in various ways and that the invention can be implemented in certain embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. An underwater gas pressurization unit comprising:

at least one vessel arranged to receive gas through a top of the vessel and seawater through a bottom of the vessel, the at least one vessel further comprising a layer of water-immiscible liquid separating between the gas and the seawater, wherein the water-immiscible liquid is selected to have a density which is intermediate between a density of the gas and a density of the seawater; and a valve system arranged to pressurize the gas by, repeatedly, introducing the seawater into the vessel, evacuating the pressurized gas through the top of the vessel upon reaching a specified pressure and introducing gas into the vessel by evacuating the seawater through the bottom of the vessel, wherein the underwater gas pressurization unit is configured to pressurize the gas continuously by the repeating of the seawater introduction, the pressurized gas evacuation, the gas introduction and the seawater evacuation, wherein the water-immiscible liquid comprises aliphatic or aromatic organic compounds or their mixtures, has a density smaller than seawater and has a freezing temperature below −20° C., and wherein the water-immiscible liquid is selected from: hexane, hexane isomers, heptane, heptane isomers, toluene, derivatives thereof and mixtures thereof, wherein the at least one vessel comprises at least one pair of vessels, in each of the at least one pair, the two paired vessels operate reciprocally—one of the vessels pressurizing gas while the other one of the vessels receiving gas.

2. The underwater gas pressurization unit of claim 1, wherein the at least one vessel is shaped as a vertical helix.

3. An underwater natural gas liquefaction system, comprising the underwater gas pressurization unit of claim 1, arranged to receive and pressurize natural gas from a natural gas production platform, and further comprising a cooling unit arranged to receive and liquefy the pressurized natural gas from the underwater gas pressurization unit.

4. The underwater natural gas liquefaction system of claim 3, wherein the cooling unit comprises another underwater gas pressurization unit according to claim 1, which is arranged to pressurize a coolant used in the cooling unit to liquefy the pressurized natural gas.

5. The underwater natural gas liquefaction system of claim 4, wherein the coolant is selected to have a boiling point at atmospheric pressure which is lower than a condensation temperature of the compressed natural gas and a critical condensation temperature of the pressurized coolant which is higher than a temperature of ambient seawater.

6. The underwater natural gas liquefaction system of claim 5, wherein the coolant is ethylene, and the underwater gas pressurization unit of the cooling unit is arranged to pressurize the ethylene to a pressure that enables ethylene liquefaction by cooling with ambient seawater.

7. The underwater natural gas liquefaction system of claim 3, further comprising a seawater disposal unit arranged to dispose the seawater evacuated from the underwater gas pressurization units.

8. The underwater natural gas liquefaction system of claim 7, wherein the seawater disposal unit is arranged to enable injection of the evacuated seawater into a pressurizing well associated with the natural gas production platform.

* * * * *